US011603693B2

(12) United States Patent
Güzeltepe et al.

(10) Patent No.: US 11,603,693 B2
(45) Date of Patent: Mar. 14, 2023

(54) FURNITURE HINGE FOR UPWARD-OPENING CABINET DOORS

(71) Applicant: Samet Kalip Ve Maden Esya San. Ve Tic. A.S., Istanbul (TR)

(72) Inventors: Nurettin Güzeltepe, Tepekent/Istanbul (TR); Artur Hirtsiefer, Neunkirchen-Seelscheid (DE)

(73) Assignee: Samet Kalip Ve Maden Esya San. Ve Tic. A.S.

( * ) Notice: Subject to any disclaimer, the term of this patent is extended or adjusted under 35 U.S.C. 154(b) by 171 days.

(21) Appl. No.: 17/296,227

(22) PCT Filed: Nov. 4, 2019

(86) PCT No.: PCT/TR2019/050922
§ 371 (c)(1),
(2) Date: May 22, 2021

(87) PCT Pub. No.: WO2020/112058
PCT Pub. Date: Jun. 4, 2020

(65) Prior Publication Data

US 2022/0018174 A1 Jan. 20, 2022

(30) Foreign Application Priority Data

Nov. 30, 2018 (TR) ..... 2018/18259

(51) Int. Cl.
*E05F 1/08* (2006.01)
*E05D 15/26* (2006.01)
*E05F 5/10* (2006.01)

(52) U.S. Cl.
CPC ..... *E05D 15/262* (2013.01); *E05F 5/10* (2013.01); *E05Y 2201/224* (2013.01);
(Continued)

(58) Field of Classification Search
CPC ..... E05F 1/12; E05F 1/1276; E05F 1/1246; E05F 1/1253; E05F 1/1261; E05F 1/1058;
(Continued)

(56) References Cited

U.S. PATENT DOCUMENTS 8,321,996 B2 * 12/2012 Hirtsiefer ..... E05F 5/02 16/354
9,719,283 B2 8/2017 Holzapfel
(Continued)

FOREIGN PATENT DOCUMENTS

CN 103109029 A 5/2013
CN 204326789 U 5/2015
(Continued)

OTHER PUBLICATIONS

International Search Report and Written Opinion of corresponding PCT/TR2019/050922, dated Apr. 24, 2020, 8 pages (not prior art).
(Continued)

*Primary Examiner* — Chuck Y Mah
(74) *Attorney, Agent, or Firm* — Lucian Wayne Beavers; Nathan I. North; Patterson Intellectual Property Law, PC

(57) ABSTRACT

The present invention determines the final opening position of the furniture door in the upward direction by means of the furniture hinge comprising an opening angle adjustment thereon. Said furniture hinge comprises a housing; a hinge arm connected axially to the furniture door from its one end and to said housing from the other end by means of a first rotating pin; a power unit that is connected axially between a lever arm and a third rotating pin and that comprises at least one spring forming a force on the hinge arm; a movement arm that is connected axially to said hinge arm from its one end and connected axially to said lever arm from the other end and that ensures the force transmission between said force unit and hinge arm; and an opening angle
(Continued)

adjustment that allows for determining the final opening position of the furniture door in the upward direction, has an adjustment element in an axially rotatable and a damper thereon and comprises a body that may move linearly by means of the axial rotation of said adjustment element.

14 Claims, 4 Drawing Sheets

(52) U.S. Cl.
CPC ..... *E05Y 2201/47* (2013.01); *E05Y 2600/13* (2013.01); *E05Y 2900/20* (2013.01)

(58) Field of Classification Search
CPC ... E05F 1/1075; E05F 3/04; E05F 5/02; E05F 3/20; E05F 3/06; E05F 3/18; E05D 3/06; E05D 3/16; E05D 11/00; E05D 15/40; E05D 2003/163; E05Y 2201/10; E05Y 2201/256; E05Y 2201/21; E05Y 2201/264; E05Y 2201/47; E05Y 2201/492; E05Y 2900/20; E05Y 2900/202; E05Y 2600/10; E05Y 2600/41; A47B 2220/0072; Y10T 16/5383; Y10T 16/547; Y10T 16/5476
See application file for complete search history.

(56) References Cited

U.S. PATENT DOCUMENTS

| | | | | |
|---|---|---|---|---|
| 10,407,962 | B2 | 9/2019 | Schluge | |
| 10,487,554 | B2 | 11/2019 | Lubetz et al. | |
| 10,597,924 | B2 * | 3/2020 | Hu | E05D 11/1014 |
| 10,914,106 | B2 * | 2/2021 | Salice | E05F 3/104 |
| 2001/0039762 | A1 * | 11/2001 | Giovannetti | E05F 1/1091 49/246 |
| 2007/0124893 | A1 | 6/2007 | Brustle | |
| 2010/0101052 | A1 | 4/2010 | Waltemate et al. | |
| 2010/0109497 | A1 | 5/2010 | Blersch et al. | |
| 2012/0260461 | A1 * | 10/2012 | Lautenschlager | E05F 5/02 16/319 |
| 2013/0031746 | A1 * | 2/2013 | Hasegawa | E05D 15/46 16/50 |
| 2013/0333291 | A1 | 12/2013 | Blum | |
| 2015/0330128 | A1 * | 11/2015 | Ng | E05D 7/125 16/65 |
| 2016/0153224 | A1 * | 6/2016 | Salice | E05D 3/16 16/65 |
| 2016/0333620 | A1 | 11/2016 | Holzapfel | |
| 2017/0044812 | A1 | 2/2017 | Schluge | |
| 2017/0292307 | A1 | 10/2017 | Hirtsiefer et al. | |
| 2017/0328103 | A1 * | 11/2017 | Brunnmayr | E05D 3/14 |
| 2018/0087307 | A1 * | 3/2018 | Hammerer | E05F 1/1246 |
| 2019/0309554 | A1 * | 10/2019 | Schärer | E05D 3/16 |

FOREIGN PATENT DOCUMENTS

| | | | | |
|---|---|---|---|---|
| CN | 205243258 | U | 5/2016 | |
| CN | 107075892 | A | 8/2017 | |
| DE | 20108249 | U1 | 9/2001 | |
| DE | 202008010012 | U1 | 11/2008 | |
| DE | 202010015091 | U1 * | 3/2012 | E05D 15/262 |
| DE | 202014102481 | U1 * | 10/2015 | E05D 15/262 |
| DE | 202014102481 | U1 | 10/2015 | |
| DE | 102015117291 | B3 * | 7/2016 | E05D 15/401 |
| EP | 2050908 | A1 | 4/2009 | |
| EP | 3091160 | B1 | 1/2018 | |
| JP | 2004068291 | A | 3/2004 | |
| WO | WO-2011020130 | A1 * | 2/2011 | A47B 96/00 |
| WO | 2012116866 | A1 | 9/2012 | |
| WO | 2015135005 | A1 | 9/2015 | |
| WO | 2015164894 | A1 | 11/2015 | |

OTHER PUBLICATIONS

China First Office Action for corresponding patent application No. 2022041902365510, dated Apr. 22, 2022, 6 pages (not prior art).

* cited by examiner

FURNITURE HINGE FOR UPWARD-OPENING CABINET DOORS

TECHNICAL FIELD OF THE INVENTION

The present invention relates to a furniture hinge that provides adjustment possibility to stop a furniture door, which opens upwards on the furniture body, at two different final opening positions.

The inventive furniture hinge comprises a hinge arm that may be connected to the furniture door and is rotatable axially on the housing by means of a first rotating pin; a movement arm connected between said hinge arm and a lever arm that is rotatable axially by means of a second rotating pin; a power unit connected between said lever arm and a third rotating pin; an opening angle adjustment, which allows to change the final opening position of the furniture door in the upward direction, has an axially rotatable adjustment element and a body that moves linearly by means of the axial movement of said adjustment element.

PRIOR ART

Furnitures are mounted at different distances from ceilings or similar surfaces according to area of its use or particularly according to user demand. Distances of the furniture bodies to these surfaces bring along the requirement that the furniture doors connected to the furniture body should be opened at different angles.

The utility model DE 20 2008 010 012 U1 discloses a furniture hinge designed for the adjustment requirement between different final opening angles for the upward-opening furniture doors. Said furniture hinge describes a furniture hinge developed so as to be used for furniture doors that can be opened and closed in the vertical direction. Said furniture hinge comprises a stopping element on the movement arm. The strike position of the stopping surface on the stopping element to the opposite surface on the furniture body is changed by means of moving said stopping element forwards and backwards in a carrying element fixed on the hinge arm. The strike position of the stopping surface to the opposite position on the furniture body determines the final opening position of the furniture door.

Another example of such furniture hinges is disclosed in the patent document numbered EP 3 091 160 B1. Said furniture hinge described in the document comprises an angle limiter supported against the activator of the damping means. Said hinge arm strikes to the angle limiter during opening the furniture door and is stopped and thus, the upward-opening angle of the furniture door is limited. Herein, said angle limiter may be mounted and demounted to/from the activator of the damping means.

The inventive furniture hinge, in contrast to the above-mentioned mechanisms, provides an adjustment mechanism that can be adjusted easily by an adjustment element, as a screwdriver, from the inside of the cabinet. The final opening position of the furniture door can be adjusted by means of a compact adjustment mechanism without mounting or demounting any additional elements.

Said furniture hinge comprises an opening angle adjustment that is easy-to-reach and adjustable even though the housing is thereon by eliminating any additional efforts such as removal of the housing during the adjustment.

The inventive furniture hinge provides possibility to carry out the adjustment of upward final opening position of the furniture door without interfering the function of a damper which is to damp the furniture door in this direction.

The present invention provides a furniture hinge that allows the change of the final opening position of the furniture door in the upward direction and an easy and reliable adjustment possibility, comprises an opening angle adjustment having an axially rotatable adjustment element, a damper thereon and a body that may move linearly by means of the axial movement of said adjustment element.

BRIEF DESCRIPTION OF THE INVENTION

The present invention determines the final opening position of the furniture door by means of the furniture hinge having an opening angle adjustment thereon. Said opening angle adjustment adjusts the furniture door to at least two final opening position in the upward direction.

Said furniture hinge may keep the furniture door on the furniture body in any intermediate positions between open and closed positions. Said furniture hinge comprises a housing; a hinge arm connected axially to the furniture door from its one end and to said housing from the other end by means of a first rotating pin; a power unit that is connected axially between a lever arm and a third rotating pin and that comprises at least one spring generating a force on the hinge arm; a movement arm that is connected axially to said hinge arm from its one end and connected axially to said lever arm from the other end and that ensures the force transmission between said force unit and hinge arm; and an opening angle adjustment that allows for determining the final opening position of the furniture door in the upward direction, has an axially-rotatable adjustment element and a damper thereon and comprises a body that may move linearly by means of the axial rotation of said adjustment element. Said opening angle adjustment converts axial rotation of the adjustment element into linear movement of the body. Said opening angle adjustment is supported by a support element.

According to an embodiment of the invention, said body comprises a channel bordered from at least two surfaces, wherein said adjustment element is located in at least one section. Said adjustment element is located within said channel bordered from its two surfaces such that it is 180° rotatable there.

Said adjustment element comprises two cylindrical elements connected to each other via a connection section with a protrusion thereon. In this case, said support element comprises at least two reciprocal housings where the cylindrical elements are located, these reciprocal housings allowing the axial rotation of the adjustment element therein. The cylindrical elements located in said housings may relocate said body communicating therewith by rotating axially said cylindrical elements on the housings by means of an adjustment means, as a screwdriver. Said body comprises a damper co-operating with a stopping element on said movement arm to damp the furniture door in the opening direction. When said damper is opened rapidly in the opening direction of the furniture door, the damper coincides with a stopping element belonging to the movement arm and the damper slows down the furniture door along the damping course. Said damper is contemplated such that it moves linearly together with the body belonging to the opening angle adjustment. The linear position of the body and thus the linear position of the damper are changed over said adjustment element and therefore, the damping point of the furniture door in the opening direction is adjusted. When the damper finished the damping course, the furniture door reaches the final opening position.

Said furniture hinge may comprise a force adjustment on the lever arm so as to be operated compatible with the furniture doors that are different weights. The connection point of the power unit to the lever arm may be changed by means of said force adjustment. In a preferred embodiment, said force adjustment may comprise a threaded screw that is located on the lever arm such that it can be rotated axially in an endless manner and wherein a holder may move on the threaded screw. Said force adjustment may comprise an adjustment element that can be reached from outside by means of an adjustment means, as a screwdriver. When the position of the holder on the endless-rotatable threaded screw adjusts by means of said adjustment element the force that will apply with different weights, speeds and sizes by the power unit to the furniture doors may be balanced, In a preferred embodiment, said furniture hinge may comprise a damping element so as to damp the furniture door in the closing direction. When the furniture door is closed rapidly, said damping element may slow down the furniture door along the damping course against actions that may damage the furniture. Said furniture hinge may comprise preferably a damping adjustment. The damping course of the damping element may be changed by means of said damping adjustment.

In a preferred embodiment, said furniture hinge may comprise a sliding element on the lever arm. Said sliding element may cooperate with the damping element. The position of said sliding element may be changed by means of the damping adjustment so as to change the damping point of the furniture door in the closing direction.

The inventive furniture hinge is described in detail in the following with the reference numbers by means of its embodiment in the annexed figures.

DETAILED DESCRIPTION OF THE FIGURES

REFERENCE NUMBERS

10 Furniture Hinge
11 Furniture body
12 Furniture Door
20 Hinge Arm
21 First Rotating Pin
22 Protrusion
30 Sliding Element
31 Damping Adjustment
32 Adjustment Means
33 Support Surface
40 Lever Arm
41 Second Rotating Pin
42 Projection
43 Force Adjustment
44 Adjustment Element
45 Gaps
50 Housing
51 Mounting plate
51.1, 51.2, 51.3, 51.4, 51.5, 51.6, 51.7 Fixing Recess
52 Screw
53 Connection Portions
60 Movement Arm
61 Plate
62 First Joint
63 Second Joint
64 Stopping Element
70 Support Element
71.1, 71.2, 71.3, 71.4, 71.5, 71.6, 71.7 Mounting Recesses
72 Recess
80 Power Unit
81 First casing
82 Second casing
83 Third Rotating Pin
84 Spring
85 Connection Element
90 Opening Angle Adjustment
91 Body
92 Adjustment Piece
92.1 Cylindrical Element
92.2 Connection Section
92.3 Extension
93 Channel
93.1 Channel Bottom
94 Abutment
100 Damper
100.1 Damper Piston
100.2 Damper Cylinder
100.3 Damper Piston Rod
100.4 Contact Point

DETAILED DESCRIPTION OF THE INVENTION

Figure 1:
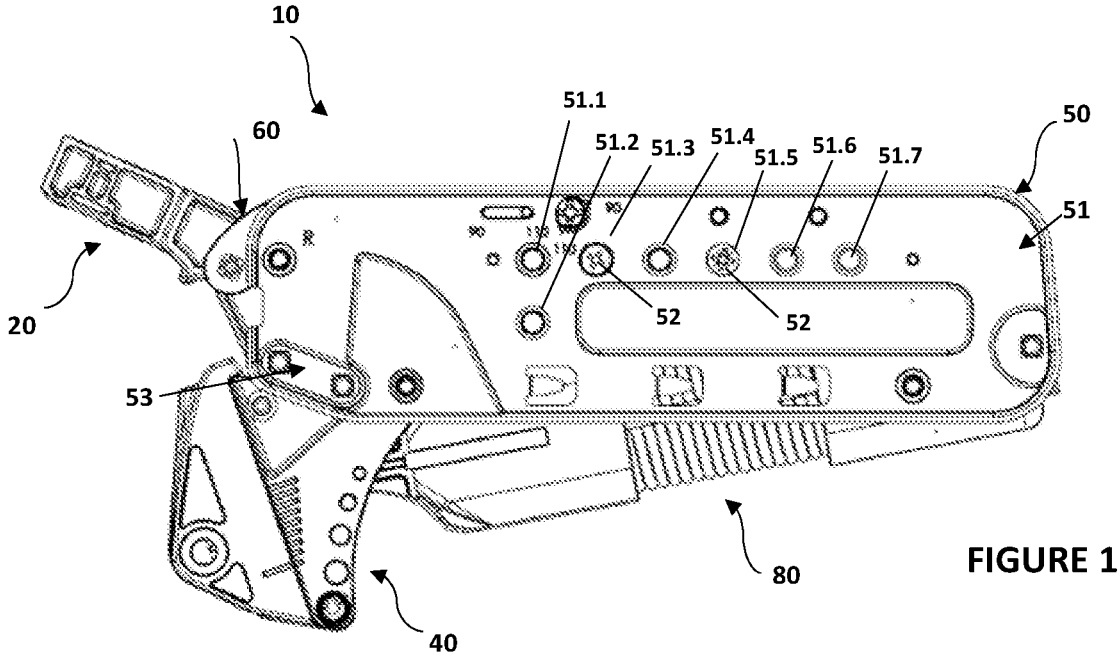
FIG. 1 shows a perspective view, wherein the inventive furniture hinge is adjusted to a first opening position and opened up to the final opening position, while there is still the mounting plate thereon.

FIG. 1 shows a view together with a housing (50), wherein the furniture hinge (10) is adjusted to the final opening position and the hinge arm (20) is opened to the final opening position. Said housing (50) carries elements located on the furniture hinge (10) and it is also utilized for the connection of the furniture hinge (10) to the furniture body (11).

Said housing (50) is comprised of two mounting plates (51) located reciprocally, wherein elements of the furniture hinge are carried between two mounting plates. Said mounting plates (51) are connected to each other over a support element (70) such that there will be a distance therebetween (FIG. 2).

Said mounting plates (51) comprise seven fixing recesses (51.1, 51.2, 51.3, 51.4, 51.5, 51.6, 51.7), formed such that they will be reciprocal to each other in case of the connection. The number of the fixing recesses (51.1, 51.2, 51.3, 51.4, 51.5, 51.6, 51.7) may be preferred less or more than seven. The furniture hinge (10) is mounted to the furniture body by means of screws (52) inserted through the mounting recesses (71.1, 71.2, 71.3, 71.4, 71.5, 71.6, 71.7) corresponding to them on the fixing recesses (51.1, 51.2, 51.3, 51.4, 51.5, 51.6, 51.7) and said support element (70). According to user's desire, the furniture hinge (10) may be screwed to the furniture body (11) by means of all or some of the fixing recesses (51.1, 51.2, 51.3, 51.4, 51.5, 51.6, 51.7) and the mounting recesses (71.1, 71.2, 71.3, 71.4, 71.5, 71.6, 71.7). In the representative embodiment shown in FIGS. 1 and 2, two screws (52) preferably are used for the connection of said furniture hinge (10).

Figure 2:
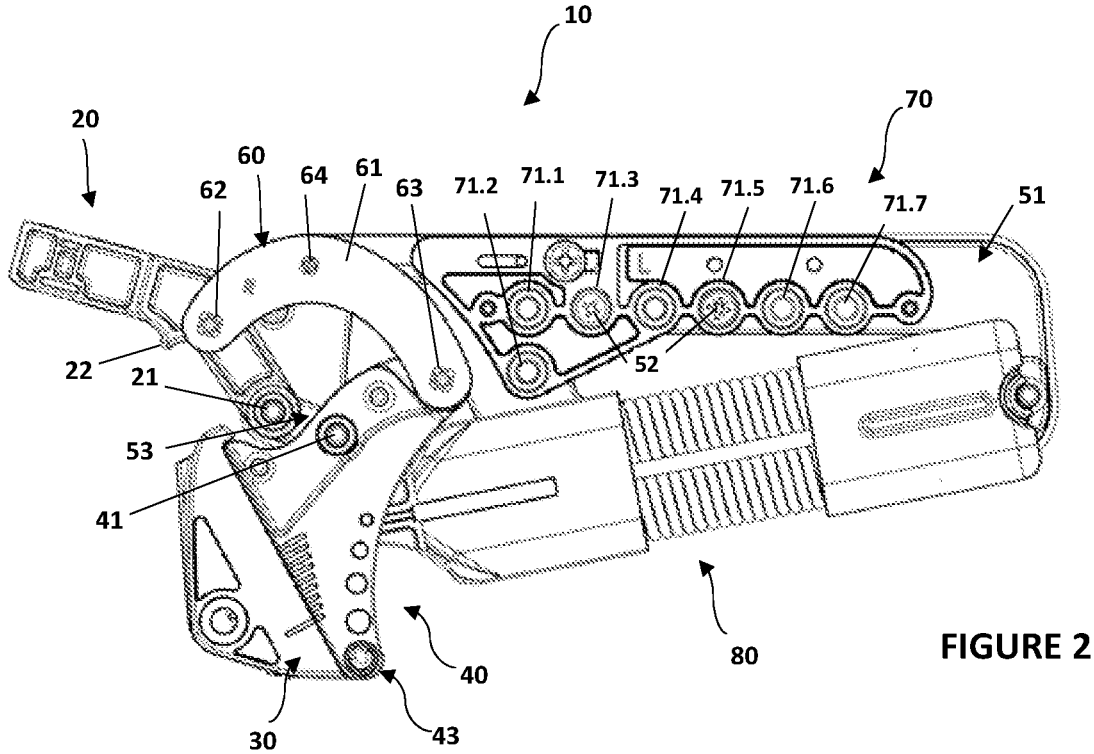
FIG. 2 shows a perspective view, wherein the furniture hinge in FIG. 1 is adjusted to the same opening position again and opened up to the final opening position, and wherein one of the mounting plates belonging to the housing is removed.

FIG. 2 shows a view, wherein one of the mounting elements (51) is removed and the inner mechanism and the other rear mounting plate (51) of said furniture hinge (10) is shown.

As it can be seen in FIG. 1 or FIG. 2, the furniture hinge (10) comprises a hinge arm (20) that can be rotated between the mounting plates (51) of said housing (50) by means of a first rotating pin (21). Said first rotating pin (21) is riveted on the mounting plates (51) positioned reciprocally from its both ends. Connection portions (53) are provided on each of the mounting plates (51) for the connection of said first rotating pin (21) to the mounting plates (51). Said connection portions (53) may be formed either by means of bending of the mounting plate (51) therein or by connecting (e.g. welding) an additional piece on the respective portion of the mounting plate (51). Thus, it is ensured that said hinge arm (10) is securely mounted between the mounting plates (51). Said hinge arm (20) both can be connected between the mounting plates (51) from its one end such that it can rotate axially and can be connected directly or indirectly to the furniture door (12) from the other end.

Said hinge arm (20) can be provided as having a variable length, preferably in a telescopic structure. Thus, it is ensured that said furniture hinge (10) may be used on the furniture in different sizes. Since the hinge arm (20) has a variable length, the furniture hinge (10) which can be utilized in cabinets with foldable doors illustrated in FIGS. 9 and 10, may become compatible for use in single-door cabinets with a adjustment of the hinge arm (20). Opting for a hinge arm (20) of this type may facilitate making adjustment including height, depth etc.

As it can be seen in FIG. 2, said hinge arm (20) is connected directly or indirectly to a movement arm (60) of the furniture hinge (10) from an end thereof by means of a first joint (62) in an axially-rotatable manner. Said movement arm (60) is comprised of two plates (61) located reciprocally. One of the plates (61) can be seen in FIG. 2. The other plate (61) is connected to the other end of the hinge arm (20) by means of said first joint (62). Said plates (61) may be contemplated preferably in the C form. Said movement arm (60) is connected to a lever arm (40) of the furniture hinge (10) by means of a second joint (63) from its other end such that it is rotatable axially. The plates (61) of said movement arm (60) are reciprocally connected to the hinge arm (20) via the first joint (62) and to the lever arm (40) via the second joint (63) in an axially rotatable manner. Said movement arm (60) ensures the force transmission between the furniture door (12) and the power unit (80).

Said movement arm (60) comprises a stopping element (64) thereon. Preferably, said stopping element (64) is a pin extending between two reciprocally plates (61). Said stopping element (64) gets strength from the connection of both plates (61) and its additional function will be described in detail in the following.

As it can be seen in FIG. 2, said lever arm (40) is connected to the housing (50) in an axially manner between said mounting plates (51) by means of a second rotating pin (41). Connection of said second rotating pin (41) to the mounting plates (51) may be established over the connection portion (53). Thus, connection of the lever arm (40) to the mounting plates (51) may be established in a secure manner.

Figure 3:
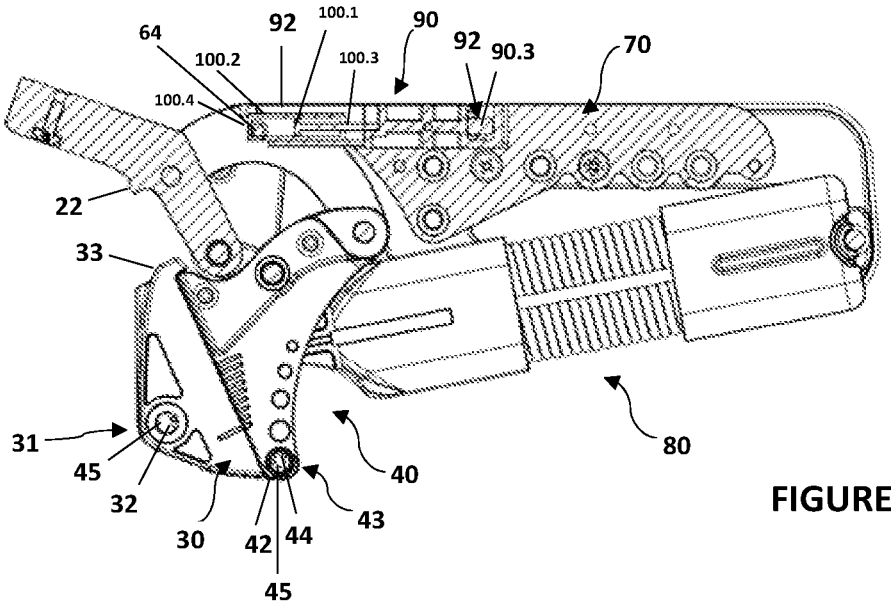
FIG. 3 shows the inventive furniture hinge together with the sectional view of the opening angle adjustment, wherein it is adjusted to the first opening position and the hinge arm is opened up to the final opening position.

As can be seen in FIG. 3, said lever arm (40) comprises a projection (42). A force adjustment (43) is provided on the projection (42). Said force adjustment (43) may comprises a adjustment element (44) and a threaded screw that can be connected to thereto. Said threaded screw is positioned to a seat in a manner in which the threaded screw may rotate freely and continuously but does not create reciprocating motion, when said adjustment element (44) is rotated. There is provided a holder which may advance on said threaded screw while it is rotating. Said holder may be a nut having a threaded inner surface. Said holder is in connection with a power unit (80).

As it can be seen in FIG. 2, said lever arm (40) comprises a sliding element (30) that can be adjusted linearly on said projection (42). Said sliding element (30) cooperates with a protrusion (22) on the hinge arm (20).

As presented in FIG. 3, said lever arm (40) may comprise a damping adjustment (31) on said projection (42). Said damping adjustment (31) may operate similarly to the force adjustment (43). Said damping adjustment (31) comprises an adjustment means (32). According to a preferred embodiment of the invention, said adjustment means (32) comprises a threaded structure. The sliding element (30) that is connected to the adjustment means (32) proceeds linearly on said projection (42) by means of rotating of the adjustment means (32) with a screwdriver.

Said lever arm (40) comprises a damping element on the projection (42) (not shown). Said damping element has a cylinder in which a piston can move linearly. The damping element may be a damping element with a liquid flow or air flow. The damping element comprises further a piston rod. The piston rod is connected with the piston in the cylinder from its one end and with the lever arm (40) from its other end. Said cylinder is in contact with the sliding element (30) through a contact surface.

While the furniture door (12) is being closed, the linear movement of the sliding element (30) on the projection (42) also moves the cylinder linearly on the piston rod. Damping course of the damping element and accordingly of the furniture door (12) in the closing direction is adjusted by means of said damping adjustment (31). The angle in which the damping in the closing direction will start refers to the damping course of the damping element. Said sliding element (30) and said protrusion (22) are in contact with one on another in the course of damping in the closing direction (along the damping course).

Said damping element comprises a compression spring that keeps the cylinder at a main position on the piston rod. The sliding element (30) continuously is in contact with the damping element over the contact surface of the cylinder by means of said compression spring. While the furniture door is being opened, the linear movement of the sliding element (30) towards the opposite direction of the damping course causes cylinder to move linearly in the opposite direction of damping on the piston rod by means of said compression spring.

In case where the damping course is being adjusted, the sliding element (30) moves together with the cylinder on the projection (42) in the opposite direction of the damping direction when the adjustment means (32) is moved linearly in the damping direction on the projection (42) by means of rotating of an adjustment tool, as screwdriver. Thus, the damping course of the damping element (33) is increased. Inversely, it is also possible to reduce the damping course with the adjustment means (32).

Figure 4:
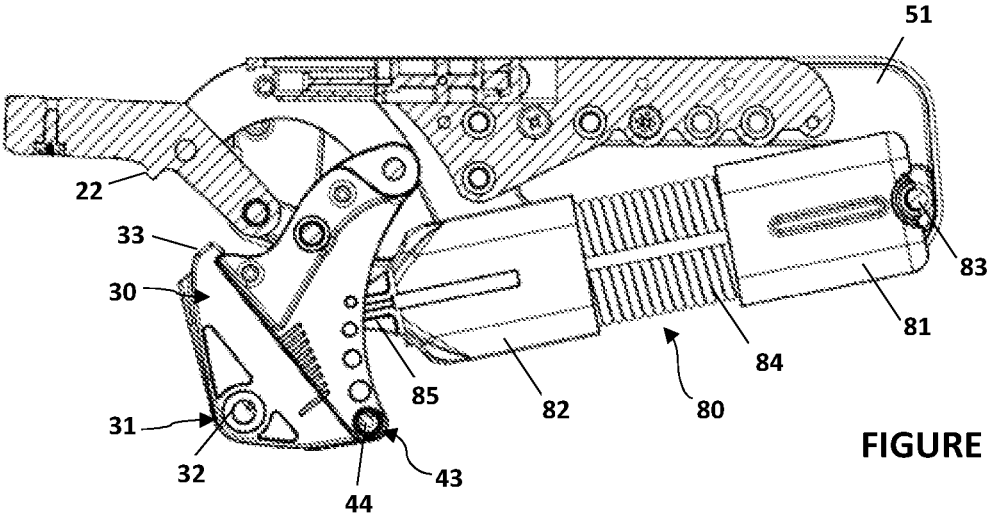
FIG. 4 shows the inventive furniture hinge together with the sectional view of the opening angle adjustment, wherein it is adjusted to a second opening position and the hinge arm is opened up to the final opening position.

As it can be seen in FIG. 3 or 4, said sliding element (30) comprises a support surface (33) cooperating with the protrusion (22) on the hinge arm (20). When the furniture door (12) is moved in the closing direction, as of the moment (angle) in which the damping in the closing direction will begin, said protrusion (22) presses onto said support surface (33) and it starts the damping of the furniture door (12) in the closing direction.

When the furniture door (12) is moved in the opening direction, while the cylinder returns towards the opposite direction of the damping direction on the piston rod, namely return to the main position, by means of compression spring inside cylinder and the sliding element (30) moves together with it towards the opposite direction of the damping direction. While the furniture door (12) is being opened, damping element which is released after the pressure of the protrusion (22) onto the support surface (33) is interrupted, returns to the main position by means of the compression spring. When the damping element is back at its main position, contact between the protrusion (22) and the support surface gets interrupted.

Said lever arm (40) is configures to be of two pieces, preferably of symmetrical two pieces in manner to include the damping element, force adjustment (43) and holder therebetween. As it can be seen FIG. 3, the adjustment element (44) of the force adjustment (43) and the adjustment means (32) of the damping adjustment (31) may be reached through gaps (45) on the lever arm (40) by means of an adjustment tool, as a screwdriver. End of the adjustment tool may enter through the connection with the adjustment element (44) and the adjustment means (32). The force adjustment (43) and/or damping adjustment (31) of the furniture hinge (10) may be performed by means of rotating the adjustment tool which is capable of getting into contact with the adjustment element (44) and adjustment means (32).

As it can be seen in FIG. 4, said power unit (80) comprises a first casing (81) and a second casing (82). Said first casing (81) is connected to at least one mounting plate (51), preferably to both mounting plate (51) in an axially rotatable manner over a third rotating pin (83). Said first casing (81) is a reservoir form, wherein at least one spring (84) may be fitted therein. Said spring (84) may be preferably a compression spring. As can be seen in FIG. 4, in this embodiment of the invention, two springs (84) is located within the first casing (81). The other end of said spring (84) is located within the second casing (82) that is a reservoir form. Said second casing (82) comprises a connection element (85). Said connection element (85) is connected with the holder in a rotatable manner.

Figure 5:
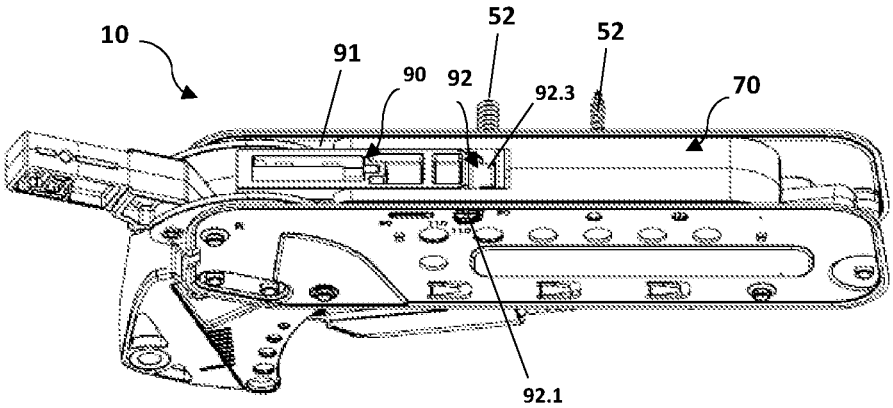
FIG. 5 shows a perspective view, wherein the furniture hinge in FIG. 1 is adjusted to the same opening position, while there is still mounting plates belonging to the housing thereon.
Figure 6:
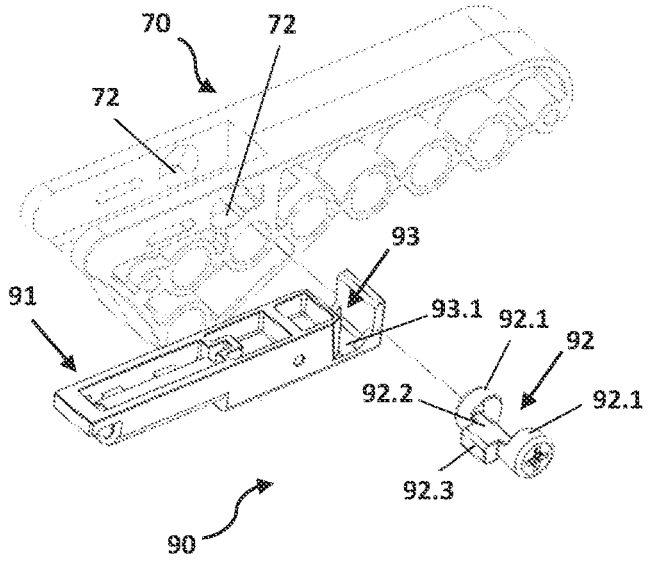
FIG. 6 shows a perspective view, wherein support element, body and adjustment element of the furniture hinge are represented separately.
Figure 7:
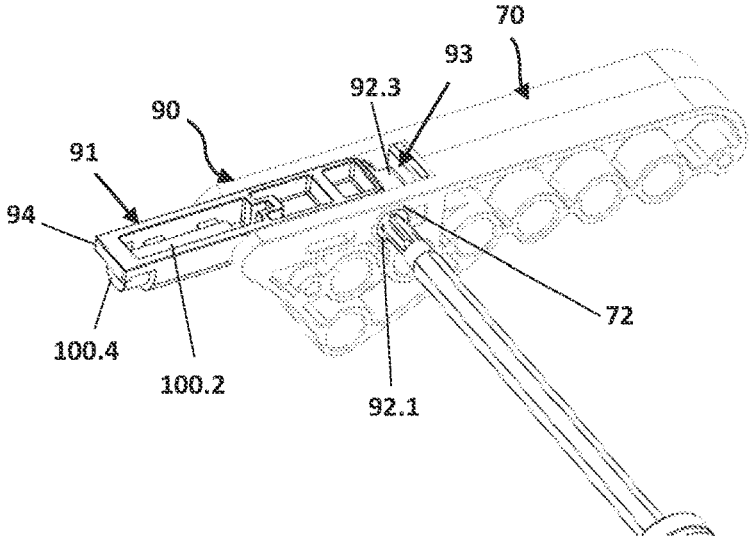
FIG. 7 shows a perspective view, wherein the body and adjustment element of the furniture hinge is positioned on the support element and adjusted to the first opening position by a screwdriver.
Figure 8:
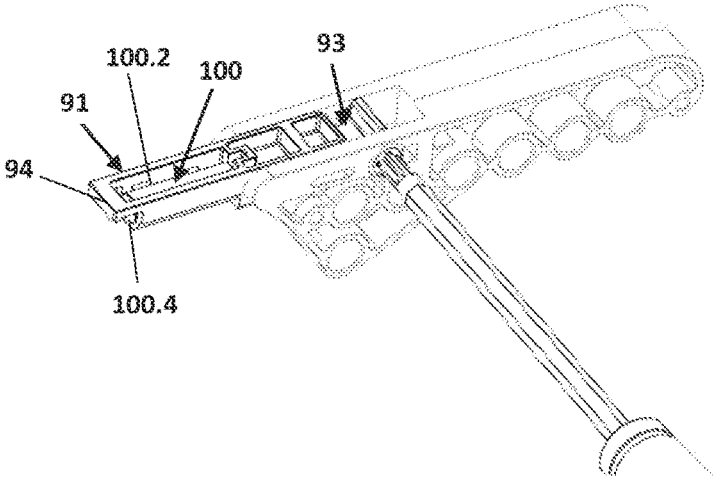
FIG. 8 shows a perspective view, wherein the body and adjustment element of the furniture hinge is positioned on the support element and adjusted to the second opening position by a screwdriver.

FIG. 5 shows a top view of the furniture hinge (10). As it can be seen in FIG. 5, said furniture hinge (10) comprises an opening angle adjustment (90) on the support element (70). Said opening angle adjustment (90) is shown in FIGS. 6, 7 and 8 in detail. Said opening angle adjustment (90) comprises a linearly-movable body (91) by means of the rotation of an adjustment piece (92). Said body (91) is supported linear-movably on the support element (70) from its one portion and in this portion, comprises a channel (93) in which said adjustment piece (92) is located. The opening angle adjustment (90) may also be referred to as the opening angle adjuster.

Said adjustment piece (92) comprises two reciprocal cylindrical elements (92.1) and a connection section (92.2) that connects them together. The connection section (92.2) comprises an extension (92.3). The cylindrical elements (92.2) belonging to said adjustment piece (92) are located in recesses (72) corresponding to them on the support element (70) in an axially rotatable manner. The cylindrical elements (92.1) belonging to said adjustment piece (92) are located in the recesses (72) on the support element (70), such that the connection section (92.2) of the adjustment element (92) extends in the channel (93). Said channel (93) is in a structure, that allows said adjustment piece (92) to rotate in 180°. The axial rotation of said extension (92.3) is limited by the channel bottom (93.1) in both directions.

Said channel (93) is limited from its both surfaces in the direction of the linear movement. When at least one of the cylindrical elements (92.1) is rotated axially by means of an adjustment tool, as a screwdriver, the extension (92.3) on the connection section (92.1) may rotate axially in the channel (93). When said extension (92.3) strikes on the surface limited in the rotation direction, the extension (92.3) has said body (91) moved linearly on the support element (70). Said body (91) may be adjusted to at least two final position by means of said adjustment piece (92). While FIG. 7 shows a view, wherein said adjustment piece (92) is adjusted to the first opening position, FIG. 8 shows a view, wherein it is adjusted to the second opening position.

As it can be seen in FIG. 8, said body (91) comprises a damper (100) that may be mounted-demounted (may be released) in a portion. As it can be seen in FIG. 3, said damper (100) comprises a damper cylinder (100.2), wherein a damper piston (100.1) may move linearly therein. The damper (100) may be a liquid flow or air flow. Said damper (100) comprises further a damper piston rod (100.3). The damper piston rod (100.3) is connected to the damper piston (100.1) in the damper cylinder (100.2) from its one end and to the body (91) from its other end. Said damper (100) comprises a contact point (100.4). When said furniture door (12) is opened in the upward direction, the stopping element (64) compresses on said damper cylinder (100.2) through the contact point (100.4) and it starts the damping in the opening direction. This position is showed in FIG. 3. The linear position of the damper (100) according to the housing together with said body (91) (50) is adjusted by means of said opening angle adjustment (90). Thus, the angle which the damping will start in the opening direction is also determined.

As it can be seen in FIG. 6-8, said body (91) comprises an abutment (94) immediately in front of the damper cylinder (100). Said abutment (94) may be an additional piece to said body (91) and may be also contemplated such that it is integrated with the body (91). When the body (91) is moved linearly by means of the adjustment piece (92), the abutment (94) also moves linearly together with it. Said abutment (94) prevents displacement of the damper cylinder (100.2). Said abutment (94) is positioned on the body (91) in front of the contact point (100.4) of the damper cylinder (100.2) such that it extends at least partially. Said abutment (94) is located in front of the damper cylinder (100.2), such that it does not prevent the contact of the damper cylinder (100.2) with the stopping element (64) on the movement arm (60) while the furniture door (12) is opened in the upward direction.

Figure 9:
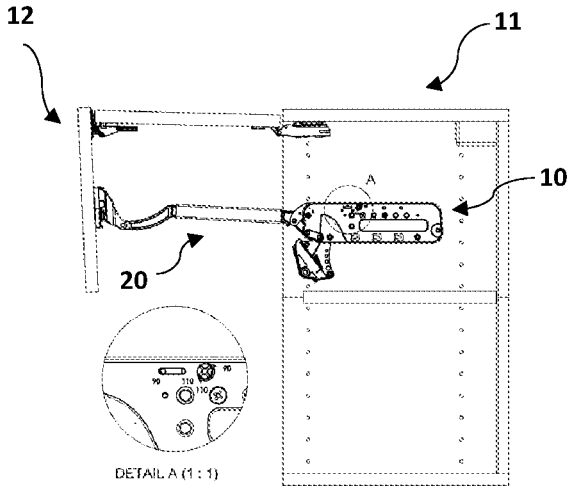
FIG. 9 shows a view, wherein the furniture door is opened up to the final opening position on the furniture body, while said furniture hinge is adjusted to the second opening position.
Figure 10:
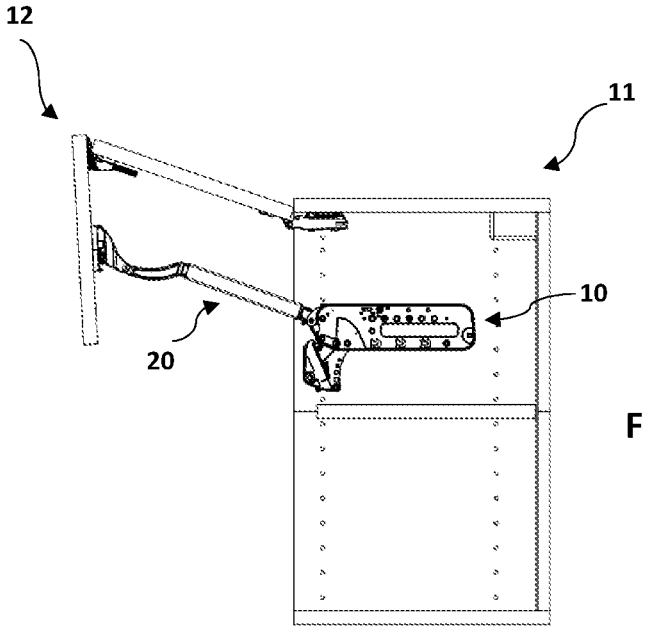
FIG. 10 shows a view, wherein the furniture door is opened up to the final opening position on the furniture body, while said furniture hinge is adjusted to the first opening position.

FIG. 9 shows a view, wherein said adjustment piece (92) is adjusted to the second opening position (FIG. 8) and wherein the furniture door (12) is opened up to the final opening position. FIG. 10 shows a view, wherein said adjustment piece (92) is adjusted to the first opening position (FIG. 7) and wherein the furniture door (12) is opened up to the final opening position.

The operation of said furniture hinge (10) is described in detail below. While the furniture door (12) is being switched from the open position to the closed position, the hinge arm (20) connected to the furniture door (12) rotates counterclockwise and also rotates the movement arm (60) through the first joint (62) in a counterclockwise manner. Said movement arm (60) ensures simultaneously to rotate the lever arm (40) through the second joint (63) in a counterclockwise manner. Said lever arm (40) is connected between the plates (51) of the housing (50) on the second rotating pin (41) in a rotatable manner.

While the furniture door (12) is being closed, the spring (84) of the power unit (80) connected between the third rotating pin (83) and the lever arm (40) applies a tractive force on the furniture door (12), when the first joint (62) passes the connection line, namely the dead point between the second rotating pin (41) and the second joint (63). Therefore, user may easily switch the furniture door (12) from the open positioned to the closed position. At this point, it is avoided that the furniture door (12) strikes rapidly to the furniture body (11) by means of the damping element actuated by the contact of the protrusion (22) on said hinge arm (20) with the support surface (33) on the sliding element (30).

Inversely, when it is desired to switch the furniture door (12) from the closed position to the open position, said furniture door (12) and accordingly hinge arm (20) must be drawn back, until the force in the power unit (80) is firstly exceeded, namely until the first joint (62) surpasses the connection line between the second rotating pin (41) and the second joint (63). When the first joint (62) surpasses the connection line between the second rotating pin (41) and the second joint (63), the force applied by the power unit (80) becomes reversed, thereby retaining the furniture door (12) at the open position again.

Said power unit (80) is capable of safely retaining the hinge arm (20) of the furniture hinge (10) and accordingly the furniture door (12) in any intermediate position between the closed position and open position (vice versa).

The damping of said furniture door (12) in the opening direction is ensured by the damper (100) on the body (91) supported by said support element (70). When the furniture door (12) is opened/pushed rapidly in the upward direction, the stopping element (64) on the movement arm (60) strikes to the contact point (100.4) on the damper (100) and starts that the furniture door (12) is damped in the opening direction. The linear position of the damper (100) is changed with said adjustment piece (92). Thus, the angle/position (damping course) in which the damping in the opening direction will start is determined.

The final opening position of the furniture door (12) in the upward direction is changed by the opening angle adjustment (90) supported by means of the support element (70). When the stopping element (64) on the movement arm (60) strikes to the contact point (100.4) of said damper cylinder (100.2), the damper cylinder (100.2) proceeds along the damping course on the damper rod (100.3). When the damping comes to the end of the damping course, the furniture door (12) reaches the final opening position in the upward direction. The linear position of the body (91) and hence, the linear position of the damper (100) can be adjusted by means of said adjustment piece (92). Thus, both the damping point of the furniture door (12) and the final opening position of the furniture door (12) in the upward direction can be changed.

The invention claimed is:

1. A furniture hinge configured to guide movement of a furniture door between a closed position and a final open position relative to a furniture body, the final open position being in an upward direction from the closed position, the furniture hinge comprising:

a housing;

a hinge arm including a first end and a second end, the first end of the hinge arm being configured to be connected to the furniture door, the second end of the hinge arm being rotatably connected to the housing;

a lever arm rotatably connected to the housing;

a movement arm including a first end and a second end, the first end of the movement arm being rotatably connected to the hinge arm, the second end of the movement arm being rotatably connected to the lever arm;

a power unit rotatably connected to the lever arm and rotatably connected to the housing, the power unit including at least one spring configured to generate a spring force against the lever arm and through the movement arm to the hinge arm; and an opening angle adjuster configured to adjust the final open position of the furniture door, the opening angle adjuster including:

a body arranged to move linearly;

a damper configured to dampen the movement of the movement arm; and a rotatable adjustment piece configured to adjust a linear position of the body upon rotation of the rotatable adjustment piece.

2. The furniture hinge of claim 1, further comprising a support element supporting the body in said housing.

3. The furniture hinge of claim 1, wherein:

the movement arm includes a stopping element; and the damper includes a damper cylinder including a contact point configured to cooperate with the stopping element to start a damping of movement of the furniture door in an opening direction.

4. The furniture hinge of claim 1, wherein:

the opening angle adjuster includes an abutment configured to prevent the damper from being removed from the body.

5. The furniture hinge of claim 1, wherein:

the body includes at least two surfaces defining a channel in the body, and the rotatable adjustment piece is received in the channel.

6. The furniture hinge of claim 1, wherein:

the body includes a channel defined in the body, and the rotatable adjustment piece is received in the channel such that the rotatable adjustment piece is rotatable by at least 180° relative to the body.

7. The furniture hinge of claim 1, further comprising:

a support element; and wherein the rotatable adjustment piece includes two cylindrical elements connected to each other by a connection section, the connection section including an extension, the two cylindrical elements being supported by the support element.

8. The furniture hinge of claim 7, wherein:

the support element includes two recesses; and the cylindrical elements of the rotatable adjustment piece are received in the two recesses to allow rotation of the rotatable adjustment piece relative to the support element.

9. The furniture hinge of claim 1, further comprising:

a force adjustment element configured to adjust a position of the rotatable connection of the power unit to the lever arm.

10. The furniture hinge of claim 9, wherein:

the force adjustment element includes a threaded screw positioned on the lever arm in an endlessly rotatable manner, and a holder movably received on the threaded screw.

11. The furniture hinge of claim 1, further comprising:

a damping element mounted on the lever arm and configured to dampen movement of the furniture door in a closing direction.

12. The furniture hinge of claim 11, further comprising:

a sliding element mounted on the lever arm and cooperating with the damping element.

13. The furniture hinge of claim 12, further comprising:

a damping adjustment mounted on the lever arm and configured to change a position of the sliding element so as to alter a damping point of the furniture door in the closing direction.

14. The furniture hinge of claim 1, wherein:

the power unit is configured to keep the hinge arm in any intermediate position between the closed position and the open position.

* * * * *